United States Patent [19]

Donatelle

[11] 4,209,927

[45] Jul. 1, 1980

[54] KNOCKDOWN SIGN TUBULAR INTERLOCKING DEVICE

[75] Inventor: Leo P. Donatelle, Chicago, Ill.

[73] Assignee: Spanjer Brothers, Inc., Chicago, Ill.

[21] Appl. No.: 923,064

[22] Filed: Jul. 10, 1978

[51] Int. Cl.[2] ..... G09F 7/18

[52] U.S. Cl. ..... 40/607; 40/155; 40/610

[58] Field of Search ..... 40/606, 607, 605, 610, 40/611, 617, 155, 152.1, 152, 624; 248/163, 159, 432, 423; 160/135, 351; 46/17, 25

[56] References Cited

U.S. PATENT DOCUMENTS

| | | | |
|---|---|---|---|
| 1,909,651 | 5/1933 | Bower | 40/606 |
| 4,068,398 | 1/1978 | Parisi | 40/607 |

FOREIGN PATENT DOCUMENTS

| | | | |
|---|---|---|---|
| 276547 | 9/1927 | United Kingdom | 40/607 |

*Primary Examiner*—John F. Pitrelli
*Attorney, Agent, or Firm*—Rummler & Snow

[57] ABSTRACT

A knockdown sign lockup device having a tubular interlocking ring for inserting in the top of a tubular signpost and engaging a slot in the top of a wing off the signboard extending within the tubular post for lockup of the signboard with the signposts.

1 Claim, 6 Drawing Figures

KNOCKDOWN SIGN TUBULAR INTERLOCKING DEVICE

BACKGROUND OF THE INVENTION

U.S. Pat. No. 4,068,398 discloses a knockdown sign assembly comprising a tongue and groove sign lockup device which requires multiple machining operations to manufacture. There is an established need for a low-cost knockdown sign lockup device which requires simple tools and a minimum of set-ups to manufacture.

SUMMARY OF THE INVENTION

The gist of this invention lies in an improved lockup for a knockdown sign which interlocks the signboard with the signposts and comprises winged extensions along each end of the signboard having downward and upward-facing slots in the top and bottom of each of the same, which extensions extend through upward-facing slots in the walls of adjacent tubular posts. The downward-facing slots in the bottom of the winged extensions interlock with the bottom of upward-facing slots in the adjacent walls of each of the tubular signposts in support relation thereof. A tubular interlocking ring having the same but smaller peripheral shape than that of the interior of the tubular post and a wall thickness which is slightly less than the width of the upward-facing slot in the top of each wing slidingly inserts in the open top of each of the posts and interlocks with the upwardly-facing slot in each of the winged extensions therein for the lockup. Rabbeted caps slip-fit in the tops of the posts to be setscrewed in place for closure of the open top of the same.

DESCRIPTION OF THE PREFERRED EMBODIMENT

Figure 1:
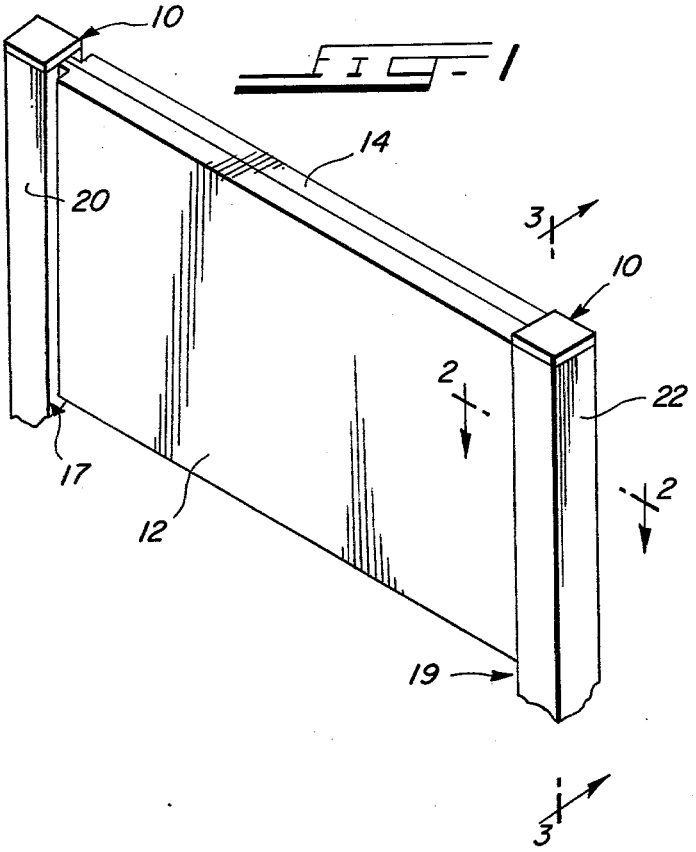
FIG. 1 shows a fragmentary pespective view of the sign frame of this invention.
Figure 2:
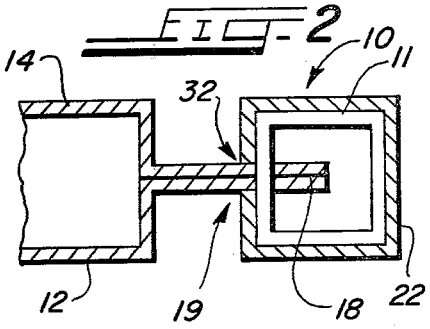
FIG. 2 shows a fragmentary cross-section along line 2—2 of FIG. 1.
Figure 3:
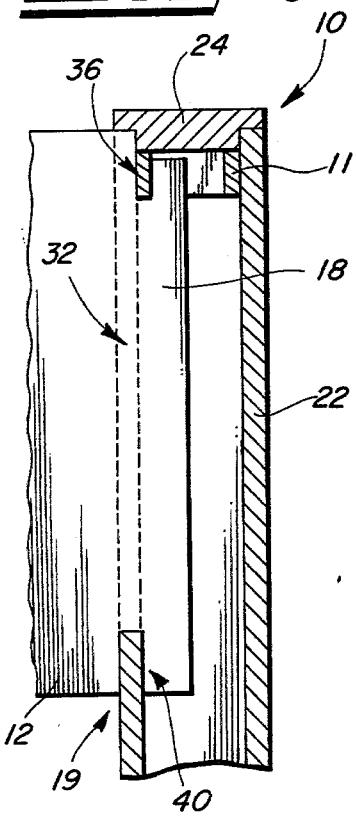
FIG. 3 shows a fragmentary cross-section along line 3—3 of FIG. 1.
Figure 4:
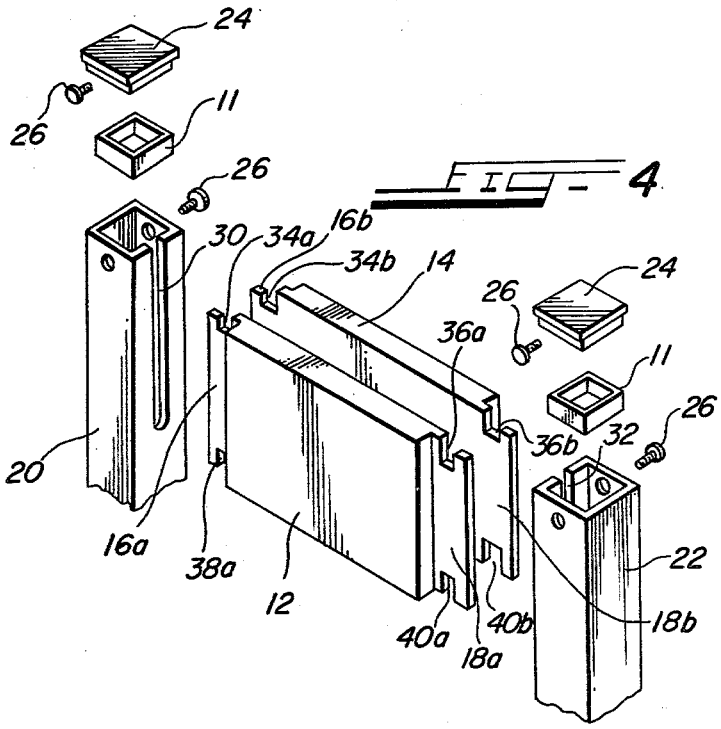
FIG. 4 shows an exploded view of the parts of the sign assembly.

Referring to FIG. 1, the sign comprises slotted lockup devices 10 which, according to the teachings of this invention, cooperate with winged extensions 16 and 18 along the ends of back-to-back panels 12 and 14, as shown in FIGS. 2 and 3, upon insertion in slots 30 and 32 in the tops of left and right-hand square, tubular posts 20 and 22, as shown in FIG. 4. Each post 20 and 22 mounts on a base (not shown) or is cast in concrete or driven into the ground and extends upwardly in a vertical direction. Square caps 24 insert into the top of posts 20 and 22 for closing off the same. Setscrews 26 mount in the caps 24 and extend through the walls of posts 20 and 22 to lock the cap 24 in place on the posts.

Referring to FIGS. 2 and 3, the panels 12 and 14 are shown assembled in the sign wherein support means 17 and 19 which mount on the bottom of each winged extension 16 and 18 at each end of panels 12 and 14 for support in the posts 20 and 22 comprise upward-facing slots 30 and 32 which are cut in the top of each adjacent wall of posts 20 and 22. Slots 30 and 32 cooperate in interlocking relation with downward-facing slots 38 and 40 which are cut in the bottom of winged extensions 16 and 18 adjacent to each end of the same. Slots 38 and 40 are slightly wider than the thickness of the wall of posts 20 and 22 for sliding over and bottoming out on slots 30 and 32 in interlocking engagement with the wall of each post 20 and 22.

Figure 6:
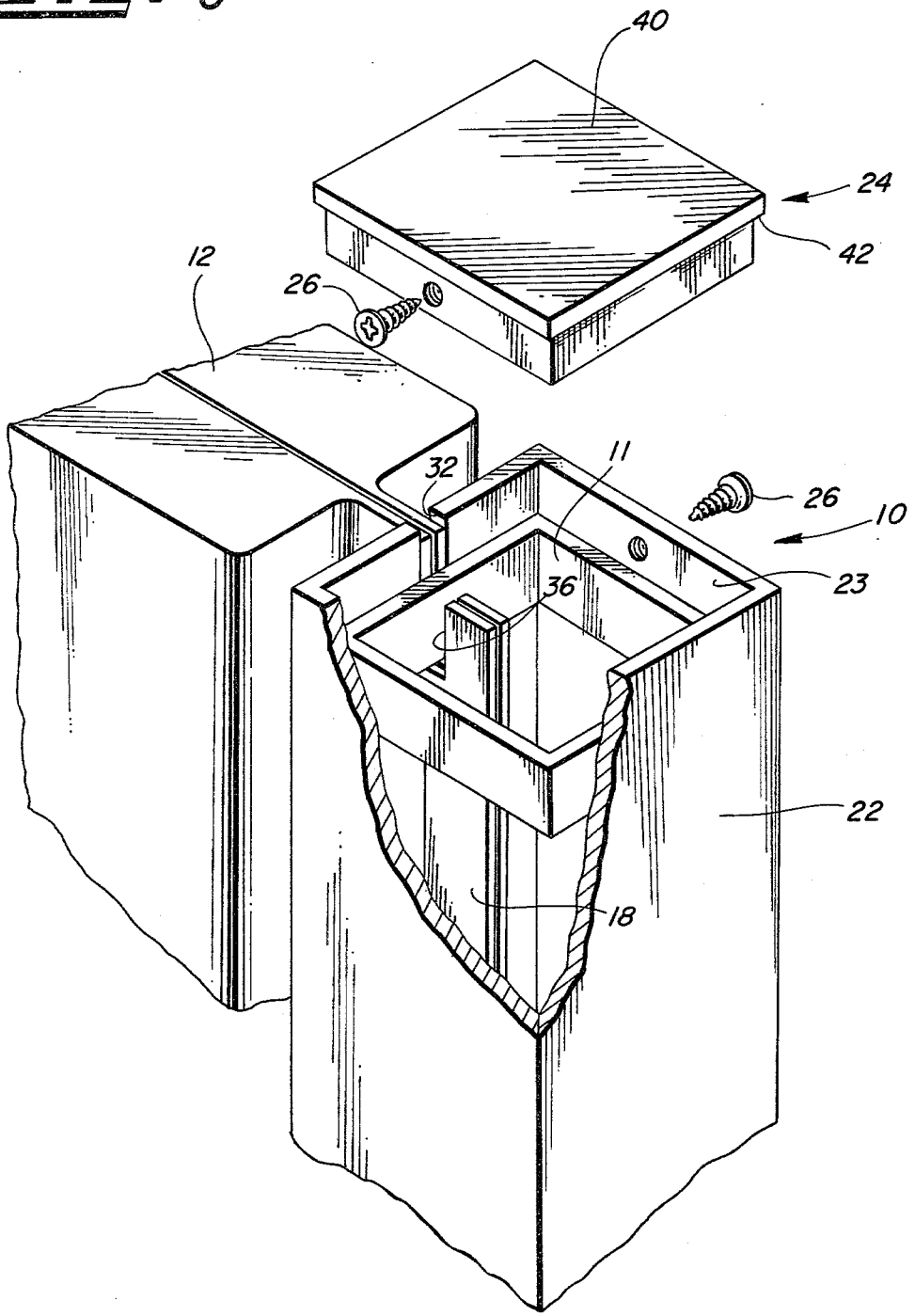
FIG. 6 shows a fragmented enlarged perspective view of the lockup device of this invention.

Upwardly-facing slots 34 and 36 are cut in the top of winged extensions 16 and 18 adjacent to each side edge of the same and to the inside wall of said tubular posts 20 and 22, respectively. Square tubular interlocking lockup rings 11 slidingly insert in the inside of tops of each of the hollow square posts 20 and 22, respectively, for engaging each of slots 34 and 36 in the top of winged extensions 16 and 18, as shown in FIG. 6. The locking rings 11 have a square outer peripheral shape like the interior of tubular posts 20 and 22 but of smaller dimension and a thickness slightly less than the width of slots 34 and 36 in said winged extensions 16 and 18. Flat projected sides 19 contact the inner surfaces 21 and 23 of the tubular posts 20 and 22. Slots 34 and 36 extend down from the top of winged extensions 16 and 18 offset in relation to slots 38 and 40 in the bottom thereof by the thickness of the walls of posts 20 and 22.

Referring to FIG. 4, the winged extensions 16 and 18 are shown in expanded relation and comprise double flanges 16*a*–16*b* and 18*a*–18*b* which extend from the right and left hand edges of the panels 12 and 14, respectively, for engaging the vertical slots 30 and 32 cut in the top of the adjacent wall of each of posts 20 and 22, respectively. The vertical slots 34*a*–34*b* and 36*a*–36*b* are cut in the top of flanges 16*a*–16*b* and 18*a*–18*b* adjacent to each side edge of the same. The locking rings 11 slidingly insert in the top of each of posts 20 and 22 for engaging slots 34*a*–34*b* and 36*a*–36*b* in the flanges 16*a*–16*b* and 18*a*–18*b*. Vertical slots 38*a*–38*b* and 40*a*–40*b* having a which slightly greater than the wall thickness of posts 20 and 22 are cut in the bottom of the flanges 16*a*–16*b* and 18*a*–18*b* and engage in interlocking relation the bottom of slots 30 and 32 in the wall of each post 20 and 22. Slots 34*a*–34*b* and 36*a*–36*b* having widths slightly greater than the wall thickness of locking rings 11 extend down from the top of winged extensions 16 and 18 in horizontal offset relation to the slots 38*a*–38*b* and 40*a*–40*b* by the thickness of the walls of posts 20 and 22.

Figure 5:
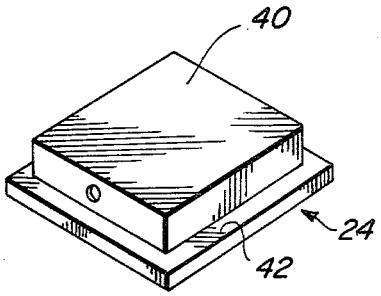
FIG. 5 shows a perspective view of the bottom of the cap.

Referring to FIG. 5, the caps 24 comprise a square plate 40 having an orthogonal rabbet 42 milled around the bottom edge of the same for slip-fitting into the top of the hollow square posts 20 and 22 for closing off the same.

Although but one specific embodiment of this invention is herein shown and described, it will be understood that details of the construction shown may be altered or omitted without departing from the spirit of the invention as defined by the following claims.

I claim:

1. In a knockdown sign having tubular posts spaced a predetermined distance apart and a signboard with winged extensions on each end supported therebetween, the improvement in lockup of said extensions with said posts comprising:

(a) a signboard lockup and support slot means in the bottom of each winged extension in cooperative support and interlocking relation with a slot in the adjacent wall of each post;

(b) a signboard lockup slot means in the top of each winged extension extending through the slot in the adjacent wall of each post within the same; and (c) a tubular signboard interlocking means operationally cooperating with the slot in the top of each winged extension within each of said posts and with the interior walls of the same, said tubular signboard interlocking means comprises an upward-facing slot in the top of the winged extension within said post adjacent to the interior wall of the same, and a tubular ring having the same outer peripheral shape as but slightly smaller size than the interior of said tubular post and a wall thickness equal to slightly less than that of the width of the upward-facing slot in the top of said winged extension in interlocking engagement with the upward-facing slot in the top of said winged extension and the interior walls of the post.

* * * * *